United States Patent [19]

Tiramani

[11] Patent Number: 4,898,307

[45] Date of Patent: Feb. 6, 1990

[54] SPRAY CAPS

[75] Inventor: Paolo M. B. Tiramani, New York, N.Y.

[73] Assignee: Goody Products, Inc., Kearny, N.J.

[21] Appl. No.: 236,592

[22] Filed: Aug. 25, 1988

[51] Int. Cl.[4] ..... B65D 37/00

[52] U.S. Cl. ..... 222/207; 222/210; 222/211; 222/213; 222/324; 222/340; 239/333; 239/496

[58] Field of Search ..... 239/333, 485, 493, 494, 239/496; 222/203, 209, 211, 213, 383, 210, 323, 324, 339, 340; 417/472

[56] References Cited

U.S. PATENT DOCUMENTS

| | | | |
|---|---|---|---|
| 1,647,219 | 11/1927 | Fulton | 222/383 X |
| 2,128,494 | 11/1938 | Morrow | 222/341 X |
| 3,437,270 | 4/1969 | Venus | 239/118 |
| 3,840,157 | 10/1974 | Hellenkamp | 222/385 |
| 3,973,700 | 8/1976 | Schmidt | 222/153 |
| 4,120,429 | 10/1978 | Vignot | 222/207 |
| 4,161,288 | 7/1979 | McKinney | 239/333 |
| 4,201,317 | 5/1980 | Aleff | 222/207 |
| 4,227,650 | 10/1980 | McKinney | 239/520 X |
| 4,249,681 | 2/1981 | French | 222/380 |
| 4,313,568 | 2/1982 | Shay | 239/333 |
| 4,358,057 | 11/1982 | Burke | 239/333 |
| 4,489,861 | 12/1984 | Saito et al. | 222/207 |
| 4,506,805 | 3/1985 | Marcon | 222/383 X |
| 4,591,077 | 5/1986 | Corsette | 222/231 |
| 4,596,344 | 6/1986 | Corsette | 239/333 |
| 4,691,849 | 9/1987 | Tada | 222/382 |
| 4,732,549 | 3/1988 | Schuckmann | 272/153 |

FOREIGN PATENT DOCUMENTS

| | | | |
|---|---|---|---|
| 02372 | 7/1982 | World Int. Prop. O. | 222/207 |

*Primary Examiner*—H. Grant Skaggs

[57] ABSTRACT

The disclosed spray cap comprises a manual trigger connected by a living hinge to a hollow main body; a joint-free member of plastic comprises a pump-chamber bellows and a discharge tube in the main body, and a projecting dip tube; a nozzle is threaded on the discharge tube; an outlet check valve body and resilient supporting arms in the nozzle form integral portions of the nozzle; and the discharge tube has a sealing flange engaging an internal cylindrical surface of the nozzle.

20 Claims, 3 Drawing Sheets

SPRAY CAPS

The present invention relates to what are commonly called "spray caps". A spray cap is attached to a container of liquid to dispense bursts when a manual actuator or "trigger" is operated.

Spray caps have long been known that meet some or all of a range of requirements. In one respect, a spray cap is to provide a spray discharge in one adjustment of its nozzle and to be positively shut off in another nozzle adjustment. As an additional alternative, the nozzle of some spray caps is adjustable to provide "stream" or "jet" bursts of discharge in addition to the shut-off and "spray" choices.

Nozzles of spray cans that are adjustable to varied settings may be leaky; and a variety of relatively complicated forms of construction have been proposed aimed at preventing such leakage.

Still further, it has long been known that air should be admitted to the liquid supply container to replace the volume of liquid that is discharged progressively, to avoid developing a vacuum in the container, such as would impair or disable the spray cap; and it has been proposed that the vent passage that avoids the vacuum should be shut when the spray cap is not in use (as during shipment) to avoid leakage of liquid by way of said vent passage.

Spray caps meeting these requirements have been available but they tend to be complicated, and their cost in parts and the expense of assembly tend to be high.

The present invention provides a spray cap that is distinctively novel in several respects. The new construction is vastly simpler, uses fewer parts and is easier to assemble than available spray caps capable of meeting all of the foregoing requirements.

In one respect, a novel nozzle-and-check valve structure is provided that is essentially one part that cooperates with the outlet end of a discharge tube, providing shut-off, spray and jet modes of operation. In another respect, a leak-preventing mount for the adjustable nozzle of a spray cap is provided, without resort to the complications of 0-rings that are usually found in such spray caps.

Still further, a spray cap is provided in which the entire liquid-containing portion that supplies the discharge nozzle is a single part. A dip tube and a bellows which constitutes a pump chamber, and a discharge tube are all combined into a continuous-wall unitary device that replaces many parts heretofore found in any single spray cap meeting the same combined requirements.

The nature of the invention and its novel aspects will be best understood and appreciated by reviewing the following detailed description of a novel spray cap that is shown in the accompanying drawings.

In the drawings:

FIG. 2 is an exploded perspective showing the components of the spray cap in FIG. 1, in their as-made conditions;

Figure 1:
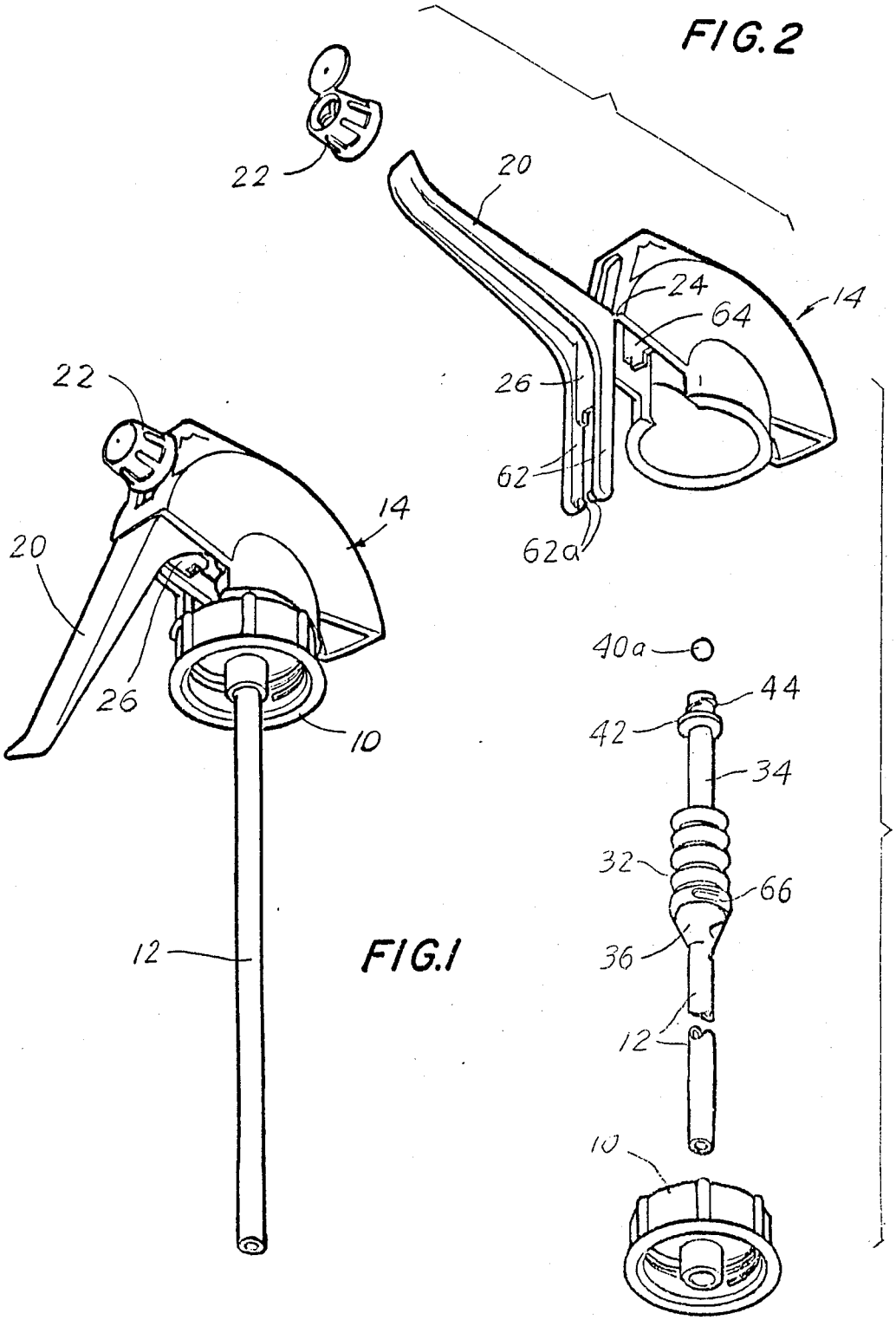
FIG. 1 is a perspective of a novel spray cap as an illustrative embodiment of the invention in its various aspects.

The illustrative spray cap in FIG. 1 includes a threaded closure 10 for a bottle or other container of liquid to be dispensed and a dip tube 12 extending downward from closure 10. A main body 14 is mounted rotatably on closure 10, for example by means of a circular rib 16 (FIG. 4) extending radially inward at the lower edge of main body 10. This rib is received in circular groove 18 around closure 10. The spray cap further includes a finger-operated trigger or lever 20 hinged to body 14, and a nozzle 22 on body 14. Trigger 20 and main body 14 in this spray cap are molded of a suitable plastic as a single unit connected by a thinned portion or living hinge 24 of the molded unit. A leaf spring 26 (FIG. 1; see also FIGS. 2–4) is an integral portion of the molded plastic trigger, thus being a portion of the molded unit.

Figure 3:
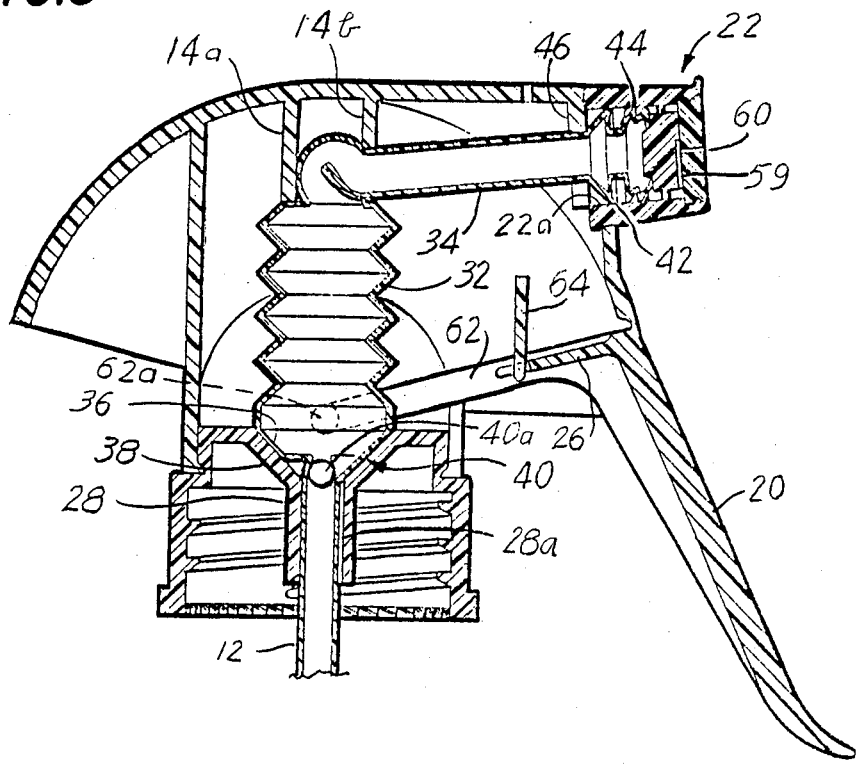
FIG. 3 is an enlarged cross-section of the spray cap of FIG. 1, the nozzle being tightened to provide a positive shutoff at that region and with the trigger in its extended at-rest or released position.
Figure 4:
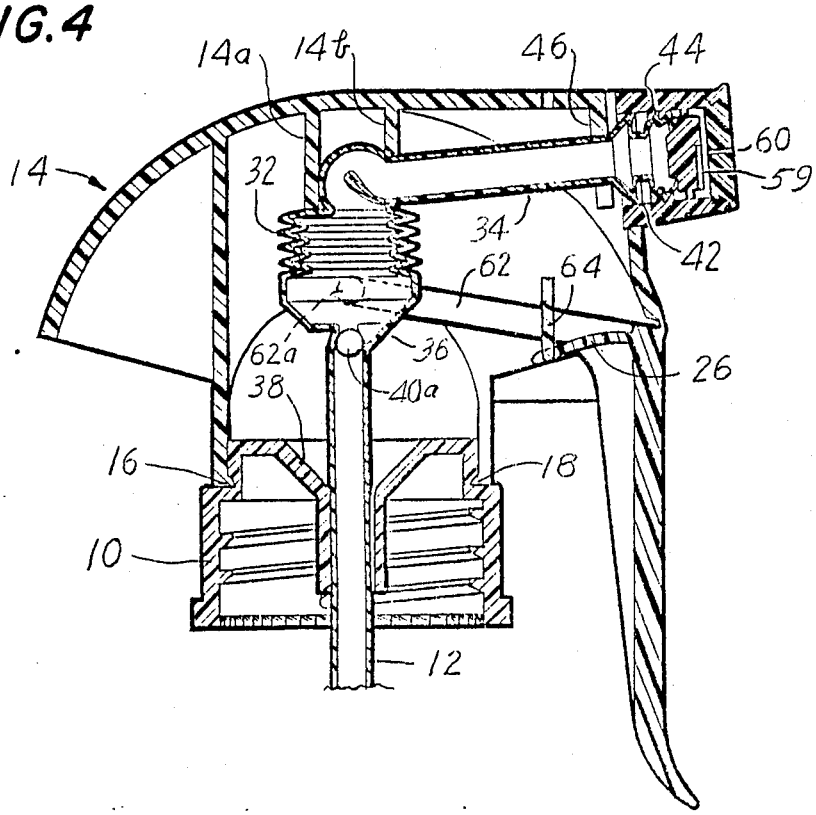
FIG. 4 is a cross-section like FIG. 3 with the nozzle set for discharging liquid and the trigger stroke being complete.

Further details of the spray cap are shown in FIGS. 3 and 4. Dip tube 12 has a sliding and rotary fit in a tubular portion 28 of closure 10; a venting passage 28*a* is formed by a groove extending from end-to-end of portion 28 along its inner surface.

Component 30 is a single part that may be produced in an injection blow-molding machine. Unit 30 comprises dip tube 12, bellows 32 and discharge tube 34 extending in a straight line as shown in FIG. 2. Component 30 may be molded of various materials, provided that bellows 32 is resilient (not merely yielding). For example, component 30 may be made of selected grades of polyethylene, polypropylene, or polyvinyl chloride. Dip tube 12, bellows 32 and discharge tube 34 (with its head or discharge end portion, detailed below) constitute the entire liquid container of the spray cap except for nozzle 22; it constitutes a continuous-wall passage for the liquid.

The lower end of the bellows 32 is a projecting conical wall 36 that has a complementary fit in concave conical seat 38 at the upper end of tubular portion 28 of the closure 10. The juncture of dip tube 12 and conical wall 38 has formations for loosely retaining ball 40*a*. The upper end of dip tube 12 internally provides a circular valve seat for ball 40*a*. That valve seat and ball 40*a* constitute the inlet check valve.

In FIGS. 2–4, the discharge end of discharge tube 34 includes an integral resilient thinned sealing flange 42 and a male thread 44. The outer diameter of flange 42 in the form shown is at least as large as the outer diameter of male threads 44. Main body 14 has a transverse wall 46 in which there is a slot that opens downward; and discharge tube 34 is received transversely in that slot, so that the formation that provides flange 42 is disposed against the surface of wall 46. Nozzle 22 is screwed onto the male thread 44 of component 30. Nozzle 22 has an internal cylindrical surface 22*a* against which flange 42 forms a seal. Main body 14 also includes two wall portions 14*a* and 14*b* which (FIGS. 3 and 4) coact with discharge tube 34 for securely locating that tube, holding the formation of flange 42 securely against wall 46. These walls also establish the position of the upper end of bellows 32. In its extended condition represented in FIG. 3, bellows 32 is slightly compressed so that its conical end portion 36 is biased against valve seat 38.

Figure 5:
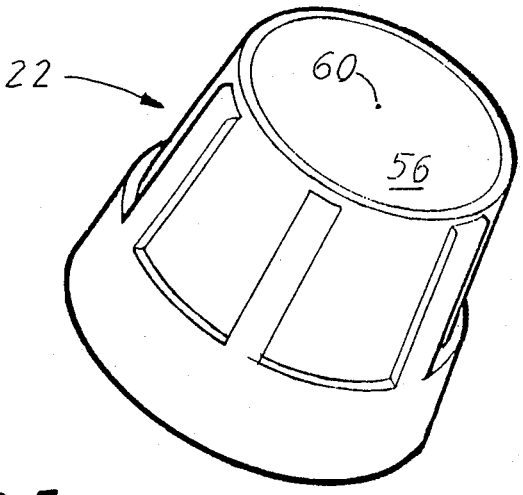
FIG. 5 is a greatly enlarged perspective view of the nozzle of the spray cap in FIG. 1.
Figure 6:
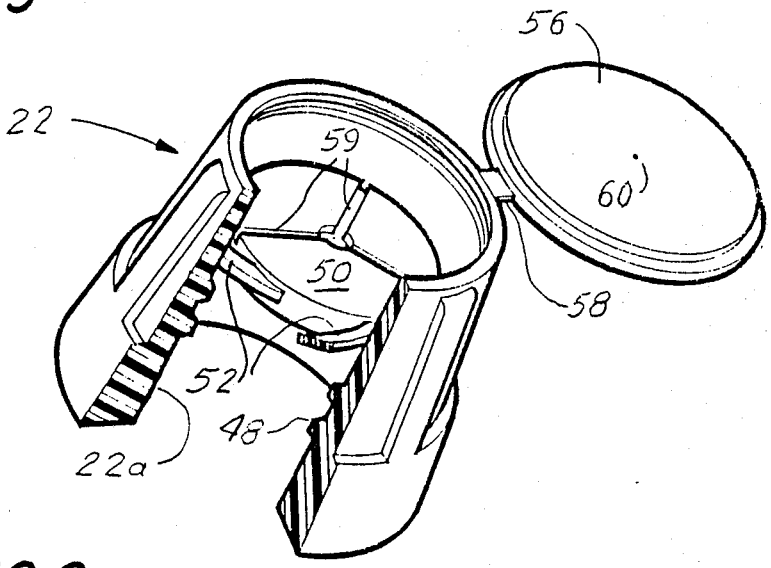
FIG. 6 is perspective view, partly in cross-section, of the nozzle in its as-molded condition.
Figure 7:
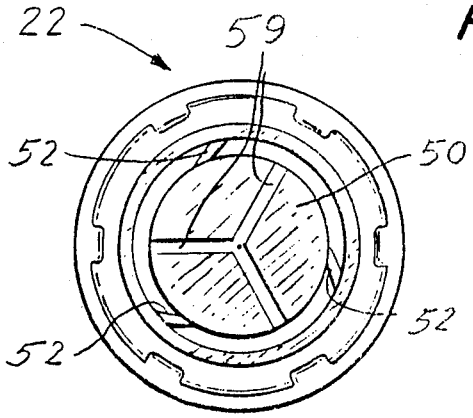
FIG. 7 is a right-hand end view of the nozzle of FIGS. 5 and 6 with its hinged cover removed.

Nozzle 22 is best shown in FIGS. 5–7. Internal or female threads 48 of the nozzle cooperate with male threads 44 of component 30. Valve body 50 is an integral portion of nozzle 22. Valve body 50 is supported by three arms 52 that extend homogeneously from both body 50 and the side wall of nozzle 22. The opposite ends of each arm 52 are displaced arcuately from each other. The arms accommodate bodily movement of member 50 along the nozzle's axis. Nozzle 22 includes a front wall 56 that is connected to the body of the nozzle by an integral hinge 58. Front wall 56 has an annular edge formation that interlocks in a leak-proof manner with a complementary annular formation in the body of the nozzle when its front or end wall is snapped into place, the completed state of the nozzle being represented in FIG. 5. The nozzle is of molded plastic. The advantage of hinging wall 56 to the rest of the nozzle is that the hinge provides automatic alignment of the front wall with the space that is to receive it. The front wall can be molded as a separate part if preferred. Nozzle 22 including its integral portions 50, 52 and 56 may be made of suitably resilient grades of polyethylene, polyvinylchloride or polypropylene, for example.

When nozzle 22 is threaded onto the head or discharge end of discharge tube 34 to the extent represented in FIG. 4 (there being a small clearance between nozzle 22 and wall 46) valve member 50 bears against the very end of tube 34. That end of tube 34 is shaped as a valve seat for valve member 50. Member 50 and its cooperating valve seat constitute a discharge check valve.

Arms 52 normally hold the valve closed in the adjustment of nozzle 22 as represented in FIG. 4. When liquid is forced into delivery tube 34 (see below) the liquid pressure lifts valve member 50 away from its valve seat and shifts member 50 toward the inner surface of end wall 56.

It may be considered that nozzle 22 is adjusted so that there is only a small clearance between end wall 56 of the nozzle and the surface of valve body 50 facing that end wall. Arms 52 press body 50 against its valve seat. Operation of trigger 20 develops pressure that lifts body 50 against wall 56. Liquid passes the circumferal edge of check valve body 50 and travels radially inward along slots 59 in body 50, and leaves the nozzle by way of a small orifice 60 through front wall 56. In this condition of the nozzle, a fine atomized spray results. This effect can be varied, as by shaping the grooves to swirl the liquid that enters the nozzle's orifice.

Nozzle 22 can be adjusted so that outlet check-valve body 50 bears against its valve seat at rest—as shown in FIG. 4—but with end wall 56 spaced away from body 50 far enough so that, when trigger 20 is operated and liquid pressure lifts body 50 away from its valve seat, a clearance space still remains between body 50 and end wall 56. In that adjustment the liquid that crosses the circumferential edge of body 50 flows across the entire common area of body 50 and wall 56; and as a result, a jet or stream of liquid leaves the orifice.

Nozzle 22 can be screwed onto threads 44 far enough so that end wall 56 of the nozzle drives valve member 50 firmly against its seat (FIG. 3), providing a positive shut-off. This guards against leakage via the nozzle without depending on resilient bias to hold the outlet check valve closed, as when the spray cap is mounted on a container filled with liquid, and the container with the spray cap in place is to be shipped.

It was mentioned above that trigger 20 is connected to the main body 14 of the spray cap by a living hinge 44. FIG. 2 shows the condition of main body 14 and trigger 20 as that composite unit leaves a molding press. Trigger 20 projects to one side of main body 14. Integral leaf-spring portion 26 in FIG. 2 is flanked by two trigger arms 62 which have in-turned spaced-apart buttons 62*a*. The longitudinal edges of the leaf spring are separated slightly from arms 63, allowing the leaf spring to become deflected in operation. Main body 14 contains a stop 64 that is directed downward, extending from an upper mounting portion which is integral with opposite walls of main body 14. Stop member 64 is widest where it extends integrally from the opposite walls of main body 14. Much of the downward-extending part of stop member 64 is narrower, providing clearance spaces between the walls of main body 14 and the opposite long edges of that part of the stop. Arms 62 of the trigger are received in those clearance spaces.

The at-rest operative condition of main body 14 and trigger 20 is represented in FIG. 3. Trigger 20 extends downward at a slight slant away from the rest of the spray cap. Integral leaf spring 26 of the trigger engages fixed stop 64 in the main body. The ends of spring 26 and stop 64, as shown in FIG. 2, have advantageously interlocking tongue-and-notch formations as assurance that their alignment and cooperation will be maintained. Arms 62 of the trigger (FIG. 3) are disposed at opposite sides of depending stop 64. Buttons 62*a* of the trigger are received under lifting shoulders 66 (FIG. 2) formed near the bottom of bellows 32 at the opposite sides of the bellows. Arms 62 of the trigger 20 sweep along opposite side edges of leaf spring 26 and along opposite side edges of stop 64 when the trigger is squeezed, ending in the position represented in FIG. 4.

The parts shown in FIG. 2 are quickly and easily assembled to form the spray cap of FIG. 1. First ball 40*a* is pressed into its detented position at the juncture of bellows 32 and dip tube 12. Then unit 30 is inserted into main body 14 in its position represented in FIG. 3, deflecting discharge tube 34 as necessary. Trigger 20 is swung into place so that buttons 62*a* are received in groove formations 66 at the bottom of the bellows. Finally, the closure 10 is forced into assembly with main body 14, tubular portion 28 of the closure sliding along the dip tube in this step of assembly.

The operation of the spray cap briefly restated. With nozzle 22 in its adjustment represented in FIG. 3, the nozzle is sealed against leakage. Its end wall 56 forces body 50 against the seat of the outlet or discharge check valve at the end of discharge tube 34. Vent passage 28*a* is sealed by the cooperation of complementary conical parts 36 and 38 of the bellows 32 and the closure 10.

When nozzle 22 is unscrewed somewhat to provide a small clearance between end wall 56 of the nozzle and the movable body 50 of the outlet check valve, body 50 at first remains biased against the outlet valve seat formed by the very end of the outlet tube 34. Squeezing trigger 20 from the position in FIG. 3 to that in FIG. 4 develops pressure that closes valve 40 and shifts member 50 against end wall 56 of the nozzle. Liquid is forced across the circumferal edge of body 50 and along channels 59, becoming a fine spray as the discharge leaves orifice 60.

Yet a further adjustment of nozzle 22 holds body 50 of the outlet check valve against its valve seat while trigger 20 remains extended, but a larger clearance space is established between body 50 and end wall 56 such that, with ordinary squeeze effort applied to the trigger, body 50 does not reach end wall 56. The liquid fills the clearance space between body 50 and wall 56 and leaves orifice 60 as a stream.

Each operation of the trigger produces a discharge burst, whether as a spray or as a stream. The extent that body 50 is lifted toward end wall 56 is adjusted by screwing the nozzle in or out; but the described modes of operation are realized by suitable design of arms 52 and choice of the material used in molding the nozzle.

After each discharge operation, trigger 20 is released and, due to the bias of its integral leaf spring 26, it returns to its starting position. Bellows 32 is operated by its resilience to return to its extended position (FIG. 3). The outlet check valve became closed when the internal pressure dropped. Therefore the negative pressure that develops in bellows 32, as it starts to become extended, opens the inlet check valve 40 and draws liquid up the dip tube to replace the discharged liquid.

The composite dip tube 12, pump-chamber bellows 32 and discharge tube 34 constitute a joint-free unit of plastic. That unit, with nozzle 22 and its check-valve body 50, represent virtually all of the spray-cap material that is exposed to the liquid to be dispensed. Ideally, ball 40*a* is of an inert material such as stainless steel. Accordingly, all of the material that is exposed to the contained liquid is—or can be—made immune to attack by or interaction with common liquids to be dispensed.

The spray cap described above is naturally amenable to modification and varied application by those skilled in the art. Consequently, the invention should be construed in accordance with its true spirit and scope.

What is claimed is:

1. A manually operable spray cap including a main body having a closure for mounting the spray cap on a supply container of liquid to be dispensed, a nozzle having a discharge orifice, means forming a liquid passage from the supply container to the nozzle, including a bellows, a dip tube extending through the closure, and a discharge tube extending to the nozzle, said bellows having a movable end portion carrying the dip tube and a stationary end portion from which the discharge tube extends, said movable end portion and said stationary end portion constituting passage-constricting transitions between the bellows and the respective tubes, said bellows including said transitions and said discharge-passage tube and at least a portion of the dip tube extending from said movable end portion constituting a continuous-wall one-piece component formed of resilient plastic, said bellows having a corrugated lengthwise-compressible self-extending side wall, intake and discharge check valves for limiting the liquid to flow toward the nozzle, and a trigger carried by said main body for operating said movable end portion of the bellows and the dip tube therewith in bellows-compressing strokes.

2. A spray cap as in claim 1, wherein the discharge end portion of said discharge tube comprises a peripherally circular sealing flange and said nozzle has an internal cylindrical surface in sealing engagement with said sealing flange.

3. A spray cap as in claim 1, wherein said discharge end portion of said discharge tube and said nozzle have cooperating threads.

4. A spray cap as in claim 3, wherein said cooperating threads are between said flange and said orifice.

5. A spray cap as in claim 1, wherein said nozzle has an end wall providing said orifice and wherein the discharge end of said discharge tube is opposite to said end wall and forms a valve seat of said discharge check valve, and wherein said discharge check valve has a valve body movably supported between the nozzle's end wall and the discharge check-valve's valve seat and normally biased to rest against the discharge check valve's valve seat but being movable toward the nozzle's end wall by liquid pressure for producing discharge bursts in response to operation of the manual trigger.

6. A spray cap as in claim 5, wherein said nozzle is adjustable for driving its end wall against the discharge check-valve's valve body while the latter is against its valve seat for thereby sealing the discharge tube.

7. A spray cap as in claim 1 wherein the movable end portion of said one-piece component comprises a vent-valve body and said closure comprises a vent-valve seat that coacts with said vent-valve body to provide a vent passage to the container when the bellows is compressed and to seal the vent passage when the bellows is extended.

8. A spray cap including a nozzle having an end wall in which there is a discharge orifice and having a side wall, a discharge tube having an open end spaced from but opposite to said end wall, a manually operable pump for delivering successive charges of liquid under pressure to said discharge tube, said open end of the discharge tube constituting the valve seat of a discharge check valve, a valve body disposed opposite to and normally spaced from said end wall of the nozzle, resilient arms movably and resiliently supporting said valve body against said valve seat, said valve body and said arms and at least the side wall of said nozzle being a one-piece molded plastic part for enabling the valve body to shift away from its valve seat and open the end of the discharge tube when liquid pressure is developed in the discharge passage, thereby to produce discharge bursts in response to operations of said pump.

9. A spray cap as in claim 8, wherein the nozzle's side wall has an internal cylindrical surface and said discharge tube has a flange integral therewith for forming a seal to said cylindrical surface, for thereby preventing leakage when the liquid pressure is developed inside the nozzle.

10. A spray cap as in claim 8, wherein said discharge tube has a male thread spaced from said valve seat and said side wall has a female thread cooperating with said male thread for adjustably positioning the nozzle so that said end wall is selectively spaced from said valve body for providing discharge bursts or forced against said valve body, thereby to hold said discharge check valve closed.

11. A spray cap as in claim 8, wherein the nozzle's side wall has an internal cylindrical surface and said discharge tube has a flange integral therewith for forming a seal to said cylindrical surface, for thereby preventing leakage when liquid pressure is developed inside the nozzle, and wherein said discharge tube has a male thread spaced from said valve seat and said side wall has a female thread cooperating with said male thread for adjustably positioning the nozzle so that said end wall is selectively spaced from said valve body thereby to allow discharge bursts or thereby pressing said end wall against said valve body and thus holding said discharge check valve closed.

12. A spray cap as in claim 11, wherein the outer diameter of said flange is at least as large as the outer diameter of said male thread and said flange is spaced further than said male thread from the open end of the discharge tube.

13. A spray cap as in claim 8, wherein said discharge tube and said nozzle have cooperating adjustment threads and wherein said valve body is biased by said supporting elements against said valve seat in an adjustment of the nozzle on the discharge tube, the resilience of said resilient arms allowing said valve body to be shifted away from said check-valve seat by said discharge bursts.

14. A spray cap as in claim 13 wherein, in another adjustment of the nozzle, the nozzle's end wall drives said valve body against its seat to constitute a positive closure.

15. A spray cap as in claim 13, said end wall and said valve body having mutually opposed surfaces, at least one of said surfaces having swirling formations therein, adjustment of the nozzle on the conduit enabling those surfaces to be separated variably to vary the character of the discharges from the orifice.

16. A spray cap as in claim 8, wherein said side wall of the nozzle in its as-molded condition has an end opening that exposes said valve body and said arms, and wherein said end wall is joined to said side wall across said opening.

17. A manually operable spray cap, including a generally hollow main body having a closure for mounting the spray cap on a supply container of liquid to be dispensed, a nozzle having a discharge orifice, and means for conveying liquid from the container through the closure to the nozzle, and intake and discharge check valves limiting the flow of liquid toward the nozzle, said liquid conveying means including a component formed as a single piece of plastic comprising a bellows portion having a corrugated lengthwise-compressible resiliently self-extending side wall, first and second opposite-end portions of said component having openings therein whose cross-section is small compared to that of the bellows, and said liquid conveying means having tubular supply and discharge passage portions extending from said first and second end portions, respectively, said second end portion and said discharge passage portion being fixed in said main body, and a trigger carried by said main body, said first end portion of the bellows and said supply tubular portion forming a movable unit that is operable by said trigger for compressing said bellows portion.

18. A spray cap as in claim 17 wherein said tubular discharge portion has a sealing enlargement and said nozzle is rotatable about said sealing enlargement and has a sealing surface that maintains sealing engagement with said enlargement despite rotation of the nozzle.

19. A spray cap as in claim 17 wherein said closure has a formation constituting a vent-valve seat and said movable unit operable by the trigger has a formation constituting a vent-valve body having sealing cooperation with said vent-valve seat when the bellows portion is extended and which allows venting of the supply container when the trigger is operated in a bellows-compressing stroke.

20. A manually operable spray cap, including a generally hollow main body having a closure for mounting the spray cap on a supply container of liquid to be dispensed, a trigger, an orifice, a liquid-container for conveying liquid from the supply container to the orifice, said liquid container being largely enclosed in said hollow main body, said liquid container including an inlet check valve disposed within a free end of a liquid passageway of the liquid container and an outlet valve for limiting the flow of liquid toward the orifice and including a bellows shaped pump chamber operable by the trigger from a starting position of the trigger and the pump chamber wherein the pump chamber is extended for driving liquid to the orifice upon compression of the pump chamber, and resilient means for extending the pump chamber, said trigger and said main body being portions of a single molded member that includes a flexible hinge interconnecting the main body and the trigger, said molded member further including a leaf-spring formation integral with the trigger for biasing the trigger to its starting position.

* * * * *